US006230463B1

(12) United States Patent
Bodine

(10) Patent No.: US 6,230,463 B1
(45) Date of Patent: May 15, 2001

(54) CEILING PANEL

(75) Inventor: Darryl C. Bodine, Lancaster, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 09/571,785

(22) Filed: May 16, 2000

Related U.S. Application Data

(63) Continuation of application No. 09/141,407, filed on Aug. 12, 1998.

(51) Int. Cl.[7] ..... E04B 5/57
(52) U.S. Cl. ..... 52/506.07; 52/506.09
(58) Field of Search ..... 52/506.07, 506.09, 52/483.1

(56) References Cited

U.S. PATENT DOCUMENTS

| | | | | |
|---|---|---|---|---|
| 365,295 | * | 6/1887 | Bright | 52/506.07 |
| 2,250,411 | * | 7/1941 | Baker | 52/506.09 |
| 2,318,092 | | 5/1943 | Olsen . | |
| 2,481,794 | | 9/1949 | Stitt . | |

(List continued on next page.)

FOREIGN PATENT DOCUMENTS

| | | | | |
|---|---|---|---|---|
| 206159 | | 11/1959 | (AT) . | |
| 213607 | * | 2/1961 | (AT) | 52/506.07 |
| 1227191 | | 8/1960 | (FR) . | |
| 1313963 | * | 11/1962 | (FR) | 52/506.09 |
| 1313963 | | 12/1963 | (FR) . | |
| 2 163 787A | | 3/1986 | (GB) . | |
| 2163787 | * | 5/1986 | (GB) | 52/506.07 |
| 2200151 | * | 7/1988 | (GB) | 52/506.09 |
| 2 204 073A | | 11/1988 | (GB) . | |
| 2 220 151 | | 12/1990 | (GB) . | |
| 2258257 | * | 2/1993 | (GB) | 52/506.09 |

OTHER PUBLICATIONS

Saint–Gobain Corporation Catalog, *ECOPHON Acoustic Ceilings Product catalog,* Products Focus DG and Focus E with Limited Warranty in back of catalog showing as Effective Date of Mar. 1996 and Last Updated: Apr. 1999, back cover seems to have a Dec. 1999 publication date.

Saint–Gobain Corporation Literature, *ECOPHON Focus Elite—the floating ceiling,* Oct. 1992.

Saint–Gobain Corporation Literature, *ECOPHON Ceiling Systems Standards, products and installation,* Oct. 1992.

Saint–Gobain Corporation Literature, *ECOPHON Ceiling Systems Standards, products and installation,* Mar. 1996.

*Primary Examiner*—Richard Chilcot
(74) *Attorney, Agent, or Firm*—Womble Carlyle Sandridge & Rice, PLLC

(57) ABSTRACT

A ceiling panel that conceals the grid in a suspended ceiling, having opposed active first and second edges with profiles different from one another, and opposed passive edges. An access kerf, and a registration kerf, at different levels in the active edges, along with a registration step in one active edge, permit the panel to be inserted, or removed, by successive hinge actions. When installed, the panel is locked to the ceiling with no visual indications on how the panel can be removed. During installation the panel is self-centering and self-aligning.

28 Claims, 6 Drawing Sheets

U.S. PATENT DOCUMENTS

| | | | | |
|---|---|---|---|---|
| 3,001,616 | | 9/1961 | Griffin . | |
| 3,032,833 | * | 5/1962 | Stanley | 52/506.07 |
| 3,248,839 | | 5/1966 | Roberts et al. . | |
| 3,332,194 | | 7/1967 | Jack . | |
| 3,488,908 | | 1/1970 | Jahn . | |
| 3,640,042 | | 2/1972 | Kidney . | |
| 3,714,753 | | 2/1973 | Jahn . | |
| 3,900,997 | | 8/1975 | Ollinger et al. . | |
| 4,189,893 | | 2/1980 | Kuhr . | |
| 4,283,891 | | 8/1981 | Moeller . | |
| 4,317,418 | | 3/1982 | Courshon, Jr. et al. . | |
| 4,696,141 | | 9/1987 | Nassof . | |
| 4,722,161 | | 2/1988 | Young . | |
| 4,760,677 | | 8/1988 | Nassof . | |
| 4,862,663 | | 9/1989 | Krieger . | |
| 5,417,025 | | 5/1995 | Nute et al. . | |
| 5,507,125 | | 4/1996 | McClure . | |
| 5,623,800 | | 4/1997 | Shinkosky . | |

* cited by examiner

CEILING PANEL

The present application is a continuation of U.S. patent application Ser. No. 09/141,407 filed Aug. 12, 1998, the content of which is incorporated herein by reference in its entirety.

BACKGROUND OF THE INVENTION

1. Field of the Invention

This invention relates to a panel for use with a supporting grid in a suspended ceiling. The panel is of the type that conceals part or all of the grid, when viewed from below.

2. Background Information

Suspended ceilings are common. They use a grid of metal beams in the form of an inverted T-section, commonly of a 15/16" flange width dimension, to support the panels. The rectangular openings formed by the grid are generally either 24"×24" or 24"×48" with correspondingly sized panels. However, irregularly shaped and sized openings and panels are used. Dimensions may be in metric units.

The present invention applies to such suspended ceilings and panels.

The panels are of various ceiling substrates, such as mineral fiber, fiberglass, wood, metal, plastic, or other compositions. They are positioned within the grid opening, and are supported by the grid. The panels are either of the type that expose the grid when the ceilings are viewed from below, or conceal the grid either fully or partially, when viewed from below. This invention involves those panels that conceal the grid when viewed from below.

Panels for a ceiling with exposed grids have a form of upper lip extending over the top of the grid with no lip on the panel below the grid. The panel hangs from the grid, by means of this upper lip. Such a panel is relatively simple to install, position and remove. These panels are not intended to be locked by themselves to the grid.

Panels that conceal the grid from below, on the other hand, pose special problems, since the portion of the edge underlying the grid interferes with any simple installation, positioning, and removal. Panels that conceal the grid, however, are desirable for among other benefits, their appearance, as well as their ability to lock to the grid. The grid can be partially or totally hidden. Additionally, since the panels of this type cover the metal grid, they can have a beneficial effect during a fire, since they serve to insulate the metal from the effects of the heat, particularly where panels are of a fire retardant material, as is generally the case.

Since panels that conceal generally have a lip below the grid as well as one above the grid, there is the potential for locking the panel to the grid. This is especially useful again during a fire, and even more so during a seismic disturbance. Falling panels during a quake present a serious threat to the safety of persons present below the ceiling, and particularly so where gatherings occur such as in auditoriums or public areas.

Panels locked to the grid which give no visual clue to their removal procedure also provide a degree of security against unauthorized access to the space above the ceiling.

Notwithstanding the desirable features of panels that conceal the grid, their use as been limited to a great degree because of problem with installation and removal. In some instances, special shaped grids must be used. In other designs, auxiliary clips or metal attachments to the grid are necessary. Generally, the space above the grid must be used in installing, or removing the panel, requiring such space to be available, thus reducing room height.

In some instances, the installer must position each panel visually from below, with a resulting slowdown in installation. Even without the necessity of visual positioning during installations, in prior art panels that conceal, the installation is a relatively slow procedure.

Often, in prior art, special tools were necessary to install or remove panels that lock or conceal.

Prior art patents relating to panels in suspended ceilings that conceal the grid, and in some instances lock, include U.S. Pat. Nos. 2,218,092, 3,640,012, 3,714,752, 3,900,997, 4,189,895, 4,696,141, 4,760,677, 4,862,663, and U.K. Patent 2,200,151B, and French patents 1,313,963, and 1,227,191. These panels show various edge designs that engage the grid.

SUMMARY OF THE PRESENT INVENTION

The panel of the present invention is easy to install in a ceiling. Two opposed active, parallel edges, designated first and second edges A and B, different from one another in profile, without interference from at least two opposed passive third and fourth edges C and D that can be the same as one another, enable the panel to be pivoted about designated active first edge A in engagement with a flange, into a generally horizontal position. The panel is then shifted to engage the opposing active edge, designated second edge B, with its adjacent grid flange. During the shift, the panel slightly rotates, seats, and locks into position. In effect, the opposed active first and second edges A and B, each with its distinctive profile from the other, serve successively as hinges, with the adjacent grid flange, to install the panel.

Since the panel is installed in the ceiling from below with no need for access to space above the grid, higher ceiling heights are possible, and there is no interference with plenum utilities during panel installation or service.

When installed, the panel a) conceals the supporting grid;

b) looks the same as the other panels in the ceiling;

c) is supported by the grid;

d) is locked in place vertically and horizontally;

e) provides no visual clue as to how the panel can be removed;

f) resists removal from random efforts by individuals unknowledgeable in the unlocking procedure;

g) strongly tends to remain in place during destructive events such as fire or seismic disturbances.

The panel is also easy to remove from the ceiling, providing the removal procedure is known. Once it is known how to locate a specific edge, the installation steps are simply reversed, to remove the panel.

No tools are necessary to install or remove the panel.

The present invention can be used not only with rectangular panels, but also with hexagonal, octagonal, and other regular and irregular shapes. It is only necessary that the panel have two active, opposing, parallel first and second edges A and B having distinctive profiles, different from one another, each with the profile disclosed herein. The remaining edges of the panel are passive.

DESCRIPTION OF THE PREFERRED EMBODIMENT

Figure 1:
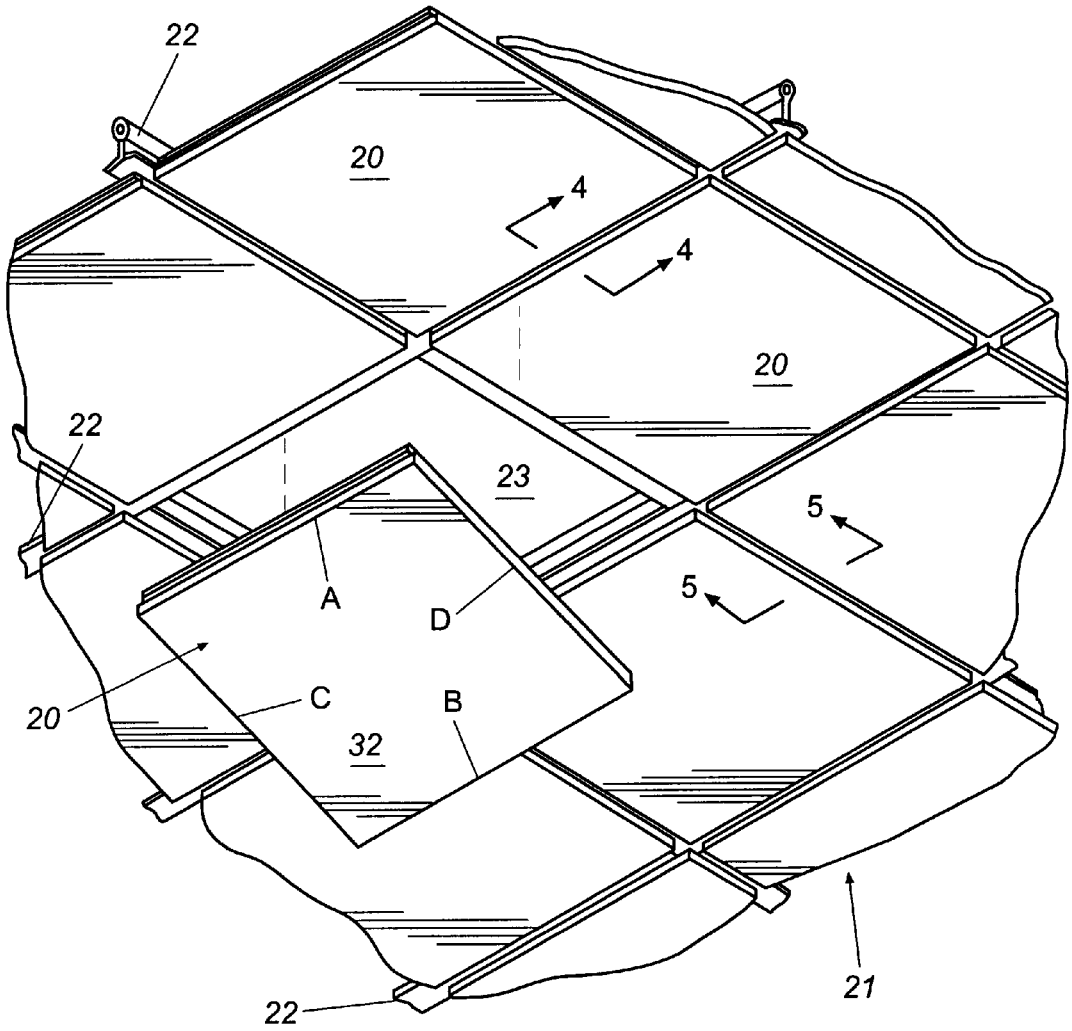
FIG. 1 is a perspective view, from below, of a ceiling that uses the panel of the invention, one of which is shown in position as it is being installed.

The panel 20 of the invention is of the type, which is installed in a grid ceiling 21, supported by metal grids 22 having inverted T cross-sections. Such grids 22 are generally used to form a square opening 23, of a 24"×24" dimension as shown in FIG. 1, or a rectangular opening, 24"–48". The present invention is applicable to either such size opening, or any other size rectangular opening, as well as hexagonal, octagonal, or other regular or irregular shapes, as will later be explained.

Additionally, a panel may carry a decor or fanciful design on its lower face, or a sculptured surface that provides a three dimensional effect to the ceiling.

In the embodiment described below, the invention is shown on a square panel, of for instance, a 24"×24" dimension.

The panel 20 can be of any various substrates, such as mineral fiber, fiberglass, wood, metal, plastic, or other composition. The substrate however, must be capable of having formed on a panel the edge profiles disclosed herein. The thickness of the panel can be determined by forming the edges and then inserting and removing the panel to determine whether the edges resist damage, and are capable of supporting the panel in the ceiling, without being damaged. A thicker panel, however, results in the use of more material, so that an economic judgment must be exerted with respect to suitability of material used in this invention.

Grid 22, as seen in cross-section in the figures, (see for example FIG. 4), has, in the well-known fashion, a bulb 25, a web 26, and a flange having sides 28 and 29. The total flange width is generally 15/16". The invention works with all size flanges. As can be seen from the detailed disclosure that follows, the profile must be correspondingly sized to accommodate the different sized flanges.

Figure 2:
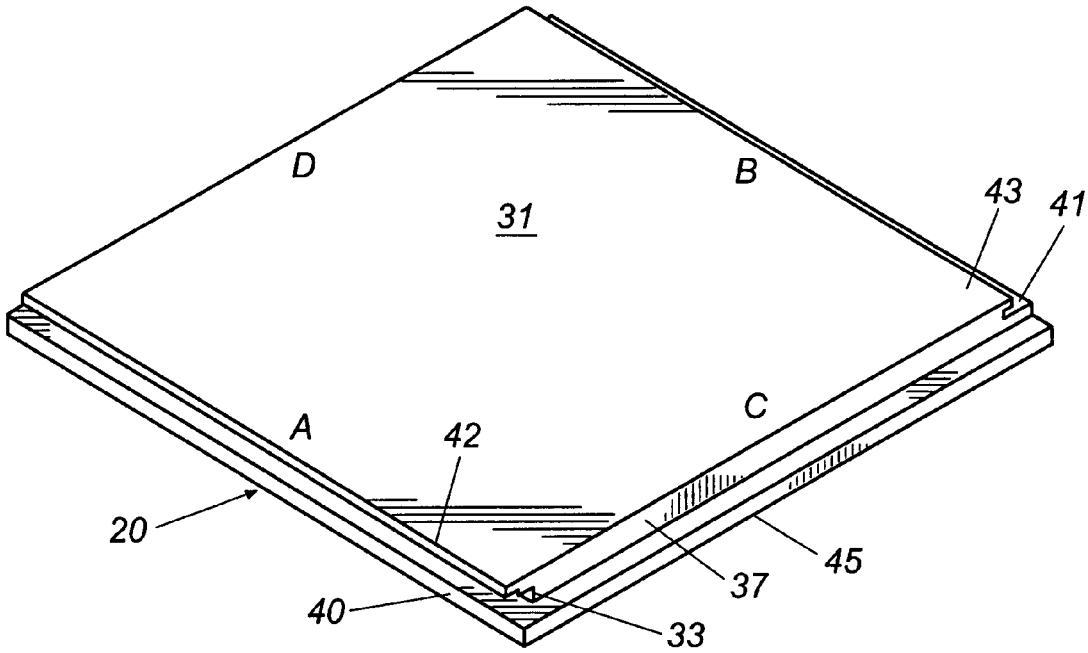
FIG. 2 is a perspective view of the panel of the invention showing first and third edges A and C.
Figure 3:
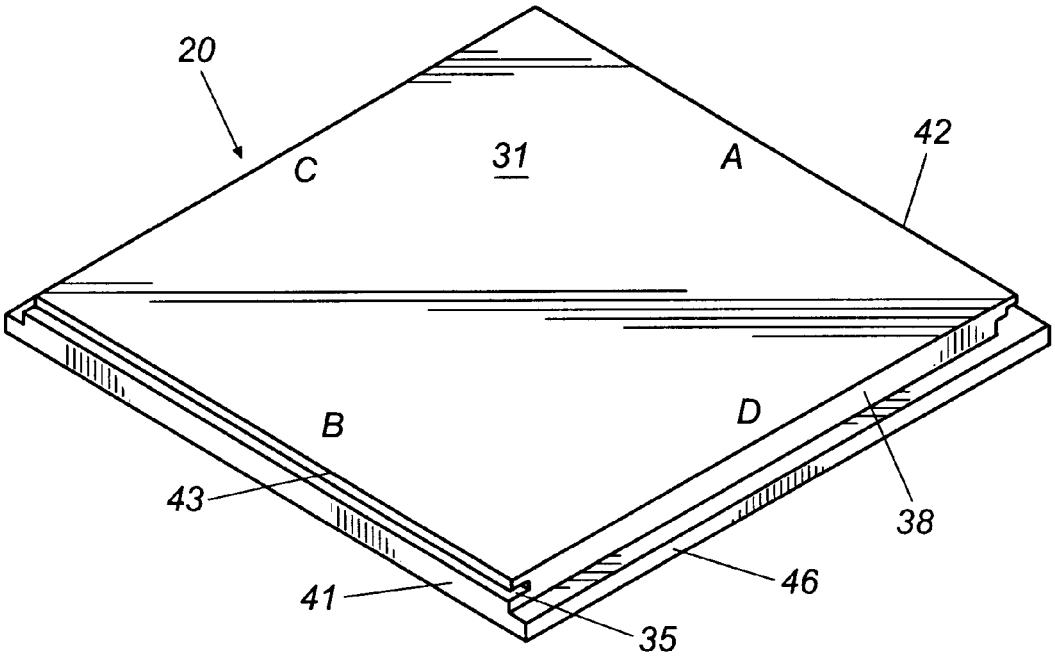
FIG. 3 is a perspective view of the panel showing second and fourth edges B and D.

Referring to FIGS. 1 and 2, the panel 20, in position in ceiling 21, has a flat top plane 31, and a flat bottom plane 32. The description of the panel in the following disclosure refers to the panel elements when the panel extends in a horizontal plane, as in a ceiling.

The invention involves opposed active first and second edges A and B, and opposed passive third and fourth edges C and D, on panel 20. First and second edges A and B, active edges, are different from one another in profile. The first and second edges A and B are active in installing and removing a panel into and from the grid as later described in the text and drawings. Third and fourth edges C and D, passive edges, are alike. These edges are passive in installing and removing the panel from the grid as later shown and described in the drawings and text. Both first and second edges A and B have a horizontally extending kerf, designated access kerf 33 on first edge A and registration kerf 35 on second edge B, intended to receive a supporting grid flange side 28 or 29. (See for instance FIG. 4.) Registration kerf 35 on second edge B has an upperside or tread 30 that extends in a horizontal plane.

Figure 6A:
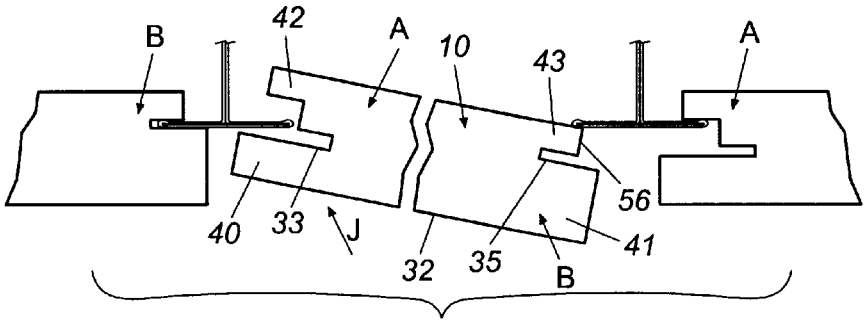
FIGS. 6A through 6D are schematic horizontal sectional views, with the panel first and second edges A and B in profile, showing the progressive steps in installing a panel in the ceiling.
Figure 6B:
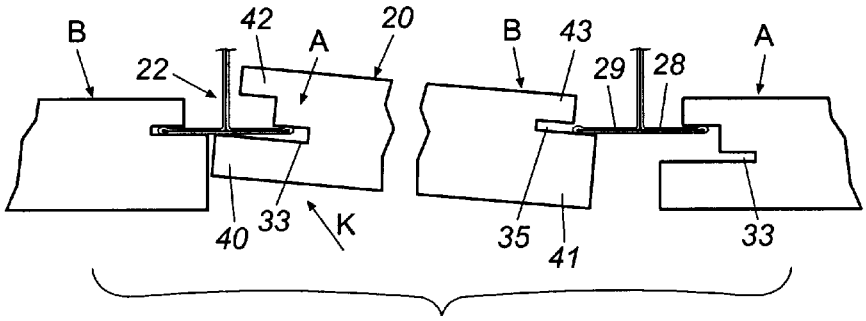

As seen, for instance, in FIG. 6B, the access kerf 33 in first edge A is thick and deep enough to slidably receive flange side 28 or 29 of the grid 22, and deep enough to permit opposite second edge B to be rotated up into a position when registration kerf 35 in second edge B aligns with its corresponding grid flange side 29.

Figure 4:
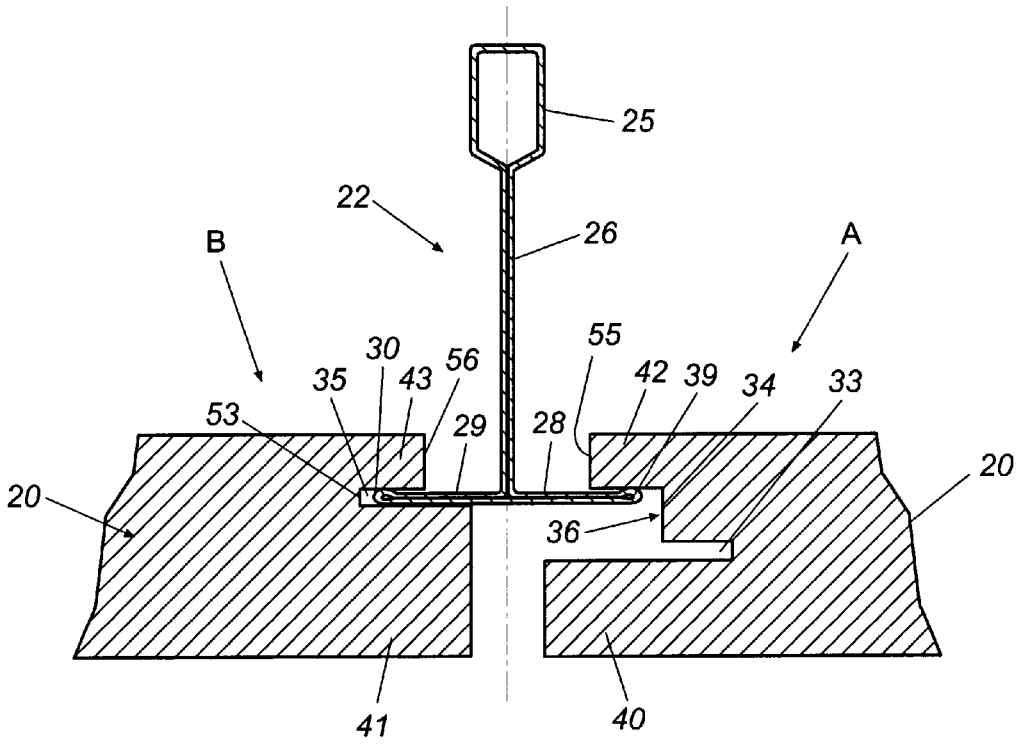
FIG. 4 is a horizontal sectional view of the ceiling taken on the line 4—4 in FIG. 1, showing first and second edges A and B of the panel in profile.
Figure 5:
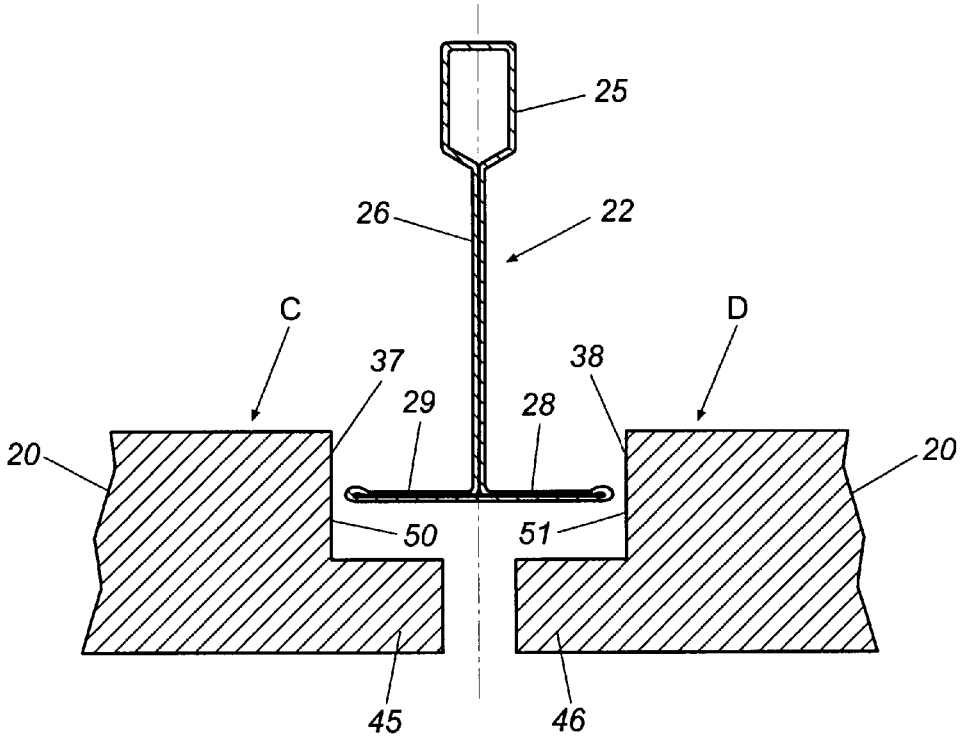
FIG. 5 is a horizontal sectional view similar to FIG. 4 taken on the line 5—5 in FIG. 1, showing third and fourth edges C and D in profile.

As seen, for instance, in FIG. 4, each of first edge A and second edge B have at least a one-step positioning riser. First edge A has a registration step 36 having a vertical riser 34 and a horizontal tread 39. Tread 39 forms the lower horizontal surface of upper lip 42 on first edge A. Tread 39 is at the same level as upper side or tread 30 of registration kerf 35 on second edge B, which forms the lower surface of upper lip 43 on second edge B. Tread 39 in first edge A and upper side or tread 30 of registration kerf 35 on second edge B form the supporting surfaces for panel 20 when the panel is in a seated position on flange sides 28 and 29, as seen in FIG. 6D. Riser 34 in registration step 36 in first edge A, and the inwardmost depth of registration kerf 35 at 53 in second edge B position the panel 20 between flanges 28 and 29 as seen in FIGS. 4 and 6B. Turning to FIG. 5, wall 37 on third edge C and wall 38 on fourth edge D, likewise position panel 20 between flange sides 28 and 29 in a direction between those edges.

Referring once again to FIG. 4, upper lip 42 on first edge A is cut back at 55, and upper lip 43 is cut back at 56 to avoid interference with the installation and removal of panel 20 into ceiling 21. Such installation and removal will be explained in more detail as follows below.

As illustrated in FIG. 4, lower lip 41 on second edge B is thicker than lower lip 40 on first edge A.

Turning to FIG. 5, lower lip 45 on third edge C and lower lip 46 on fourth edge D also contribute to locking the installed panel 20 to the grid 22, as well as concealing the grid. The panel 20 is positioned horizontally within ceiling opening 23, (FIG. 1), by registration kerf 35, riser 34 of registration step 36, (see FIG. 4), and wall 37 on third edge C and wall 38 on fourth edge D, (FIG. 5). Third and fourth edges C and D also have cutouts 50 on third edge C and 51 on fourth edge D, which permit installation and removal of the panel 20 without interference from these edges.

Access kerf 33 and registration kerf 35 are at different levels in the thickness of the panel 20. As viewed in profile, registration kerf 35 is at a higher level in the panel than access kerf 33. This permits a hinge action in the installation and removal of the panel as will be evident from the later explanation.

Turning again to FIG. 1, the first, second, third and fourth edges A, B, C, and D, respectively, on the rectangular panel 20 of the invention provide means for installing, positioning, locking, unlocking, and removing the panel 20 in and from a suspended ceiling 21 supported by a grid 22. The same means used for installing and locking are used to unlock and remove the panel 20 from the ceiling 21. The panel first, second, third and fourth edges, A, B, C, and D, respectively, also have means to conceal the flange sides 28 and 29 of the supporting grid 22 when the panel 20 is in place in the ceiling 21.

a) The First Step in Installing

The means for installing include the access kerf 33 in first edge A and registration kerf 35 in second edge B of the panel. The registration kerf 35 in second edge B is at a higher level in the panel than access kerf 33 in first edge A. Both kerfs extend in horizontal planes.

Generally, the panel 20 is first brought into position toward the ceiling in an inclined position, as shown in FIGS. 1 and 6A, with first edge A uppermost. As seen particularly in FIG. 6A, arrow J denotes the angle and motion of first edge A as it is being positioned. As seen in FIG. 6B, the panel 20 is installed by first engaging the access kerf 33 in first edge A to form with the grid flange side 28, a hinge to pivot the panel 20 to a generally horizontal position in the ceiling 21, against the grid 22, wherein lower lip 41 on second edge B abuts flange side 29. Likewise, arrow K denotes the angle and motion of first edge A as it continues to be positioned. At this point, the registration kerf 35 in second edge B will align with the adjacent flange side 29.

b) Second Step in Installing and Positioning

Figure 6C:
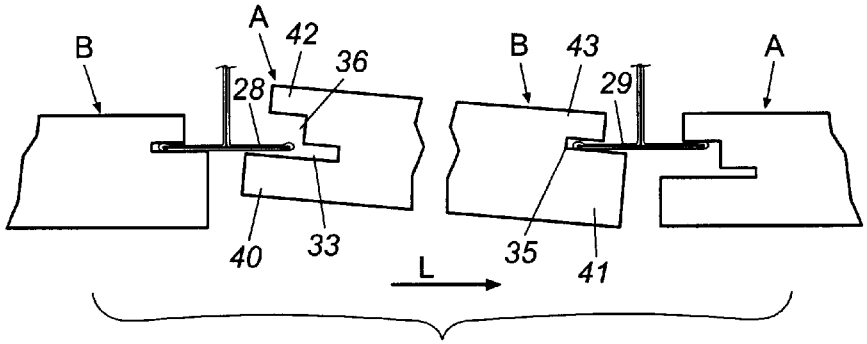
Figure 6D:
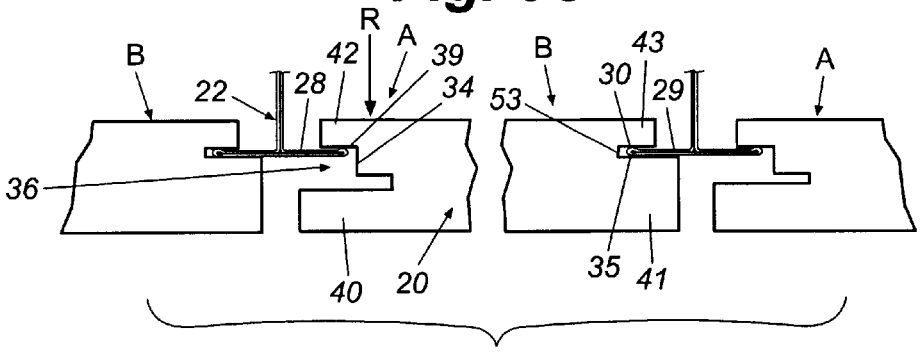

The entire panel 20 is then shifted, or translated, toward the right as seen in FIG. 6C, (see particularly arrow L, which shows the shifting motion in the direction opposite from that of arrows J and K), toward second edge B to seat the registration kerf 35 in second edge B on its adjacent flange side 29 on the grid 22. In other words, the panel 20 is shifted to engage flange side 29 with registration kerf 35. As this shift occurs, the access kerf 33 in first edge A slides away from and out of its adjacent flange side 28, permitting first edge A to drop, (the motion of which is shown by arrow R), until it reaches the tread 39 of registration step 36, as seen in FIG. 6D. Likewise, upper side or tread 30 of registration kerf 35 of second edge B seats on the upper surface of flange side 29. The panel 20 now lies in the horizontal plane of the ceiling, since the level of the tread 39 of the registration step 36 in first edge A is the same as that of the upper side or tread 30 of registration kerf 35 in second edge B, as seen in FIG. 6D.

The panel 20 can be slightly shifted back to the left against the vertical riser 34 of registration step 36, in what in effect is a feedback effect. This enables the installer to readily and virtually automatically minutely position the panel horizontally with a minimum of visual judgment, using simply a technique of feel.

c) Locking

The registration kerf 35 in second edge B, the registration step 36 including riser 34 and tread 39 in first edge A, vertical walls 37 and 38 on third and fourth edges C and D, and lips 40 to 43, 45 and 46 on first, second, third and fourth edges A, B, C, and D, respectively, all act to lock the panel 20 to the grid 22, (see, for instance, FIGS. 4, 5, and 6D). As shown in, for instance, FIG. 4, the registration kerf 35 can be vertically dimensioned so as to grasp both the under and upper side of flange side 29, thus assisting in vertical locking of the ceiling panel 20. Likewise and as indicated in the drawings, horizontal locking of the ceiling panel 20 may be accomplished by, for instance, proximally engaging the riser 34 and wall 53 with the edge of flange sides 28 and 29, respectively.

d) Removal

When viewed from below, the grid 22 is partially concealed in the embodiment described or totally concealed in an embodiment described later. The panels 20 give no clue as to how they were installed, or how they can be removed.

For removal, the steps necessary to install the panel 20 are reversed. The remover cannot determine by sight the edge on which to begin the removal procedure, since the panel 20 gives no clue. Indiscriminate efforts to lift or shift the panel are resisted by the panel, which is locked in position. It is necessary to know the removal procedure, which involves an exploratory gentle lift upward on the panel, preferably at the center, to determine which edge moves the most. The edge that moves the most is first edge A. Thus one knowledgeable in the removal process can begin the removal procedure knowing the directions required to maneuver the panel.

The panels 20 are removed in steps opposite to that in installation. To know where to begin, however, one must know which is first edge A. Random exploration without knowing what one is looking for does not cause the panels to unlock.

Figure 7A:
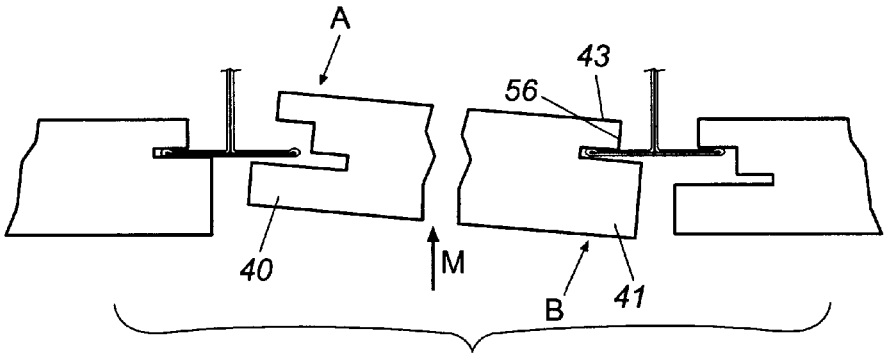
FIGS. 7A through 7D are schematic horizontal sectional views with the panel first and second edges A and B in profile, showing the progressive steps in removing a panel from the ceiling.
Figure 7B:
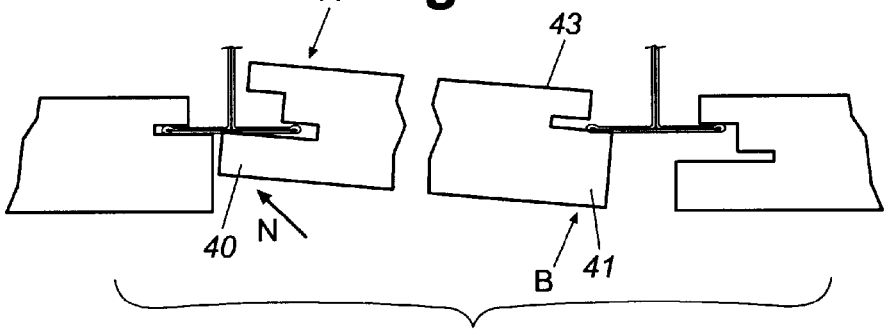
Figure 7C:
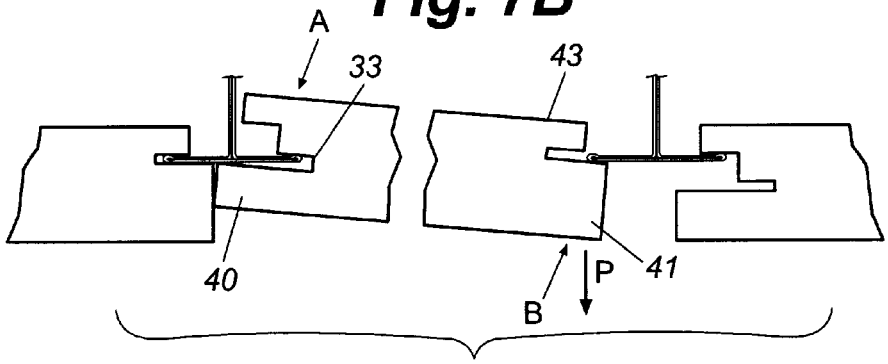
Figure 7D:
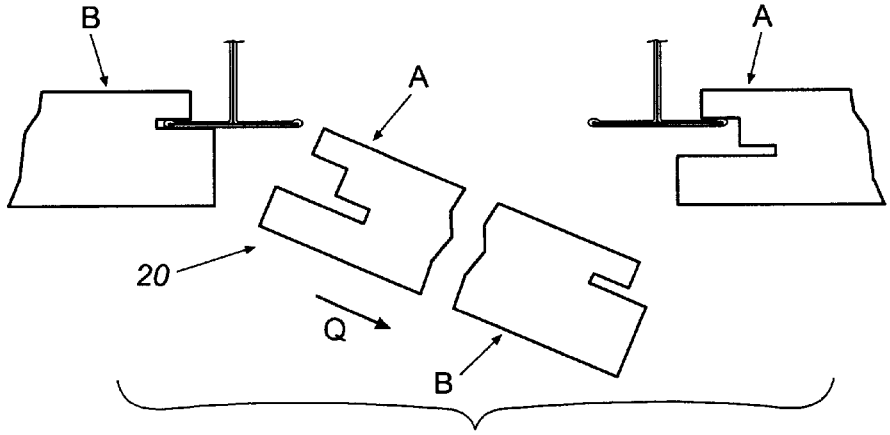

Turning to FIG. 7A, when a slight upward force (as shown by arrow M) is exerted on the center of the panel 20, first edge A will move slightly upward about the registration kerf 35 in second edge B as a hinge. There is no interference from third and fourth edges C and D to this movement. One can then proceed with removal, based on the reversal of the installation steps. As seen in FIG. 7B, the panel 20 is shifted to the left while the force shown by arrow M is continuously exerted on the panel 20. The shifting motion and force is shown by arrow N. This permits second edge B to drop out of the grid 22 as seen in FIG. 7C. (Arrow P depicts the motion of the panel 20.) Panel 20 can then fall free, as in FIG. 7D and as shown by arrow Q.

Figure 8:
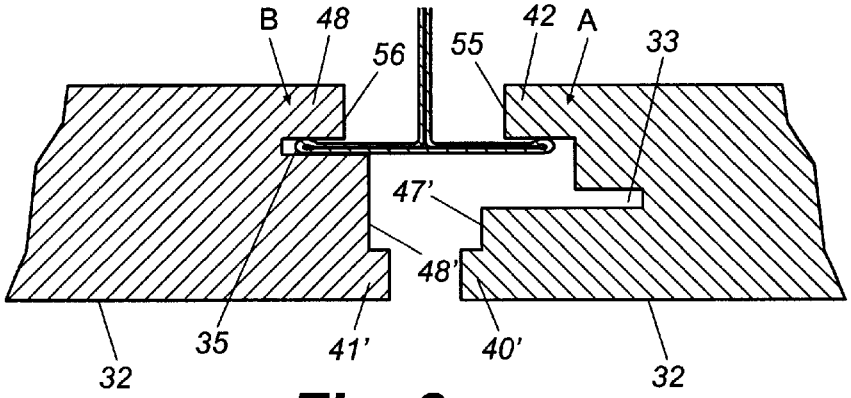
FIG. 8 is a partial sectional view of panels that conceal the grid to a greater degree than the panels shown in FIGS. 6A through 6D.
Figure 9:
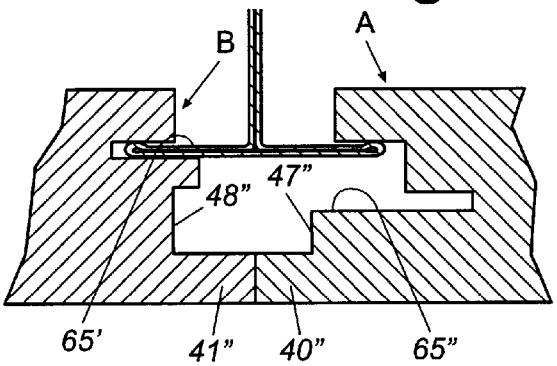
FIG. 9 is a partial sectional view of an embodiment of the invention where first and second edges A and B of the panels totally conceal the grid.
Figure 9A:
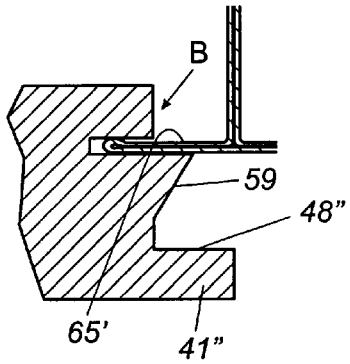
FIG. 9A is a view similar to FIG. 9 showing an alternative embodiment of second edge B, where first and second edges A and B conceal the grid.

In FIG. 8, there is shown an alternative embodiment that conceals more of the grid than that of the embodiment described earlier. Lower lip 40' on first edge A has a cutout 47', and lower lip 41' on second edge B has a cut-out 48', which permit the insertion and removal procedure described above to take place without interference. In FIG. 9, cutouts 47' and 48' in lower lips 40' and 41' again permit installation and removal of the panel, where the panels totally conceal the grid. In FIG. 9A, cutout 48' is beveled at 59 to yield more space than the square cutout of FIG. 9.

It is important to note that there remains above cutouts 47' and 48' extended surfaces 65' and 65'. These surfaces serve to guide access kerf 33 and registration kerf 35 into alignment with the adjacent grid flange and contribute to the feedback positioning aspect of the invention.

Lower lips 40' and 41' in the embodiment of FIG. 8, and lips 40' and 41' in the embodiment of FIG. 9 are suitably extended to provide the degree of grid concealment desired. Lower lips 45 and 46 on passive third and fourth edges C and D are also modified to provide the degree of grid concealment desired (not shown).

Any or all of the lower lips in any of the embodiments of the invention may be of irregular shape, such as scalloped, when viewed from below, to provide a further decorative effect to the ceiling.

Figure 10:
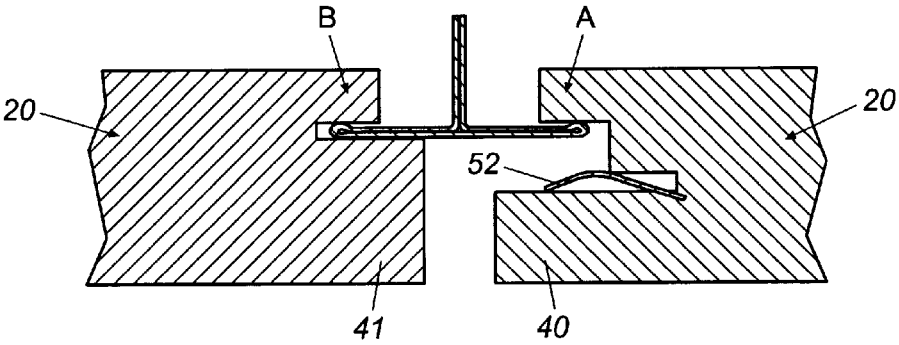
FIGS. 10 and 11 show a panel in partial sectional view having a locking spring.
Figure 11:
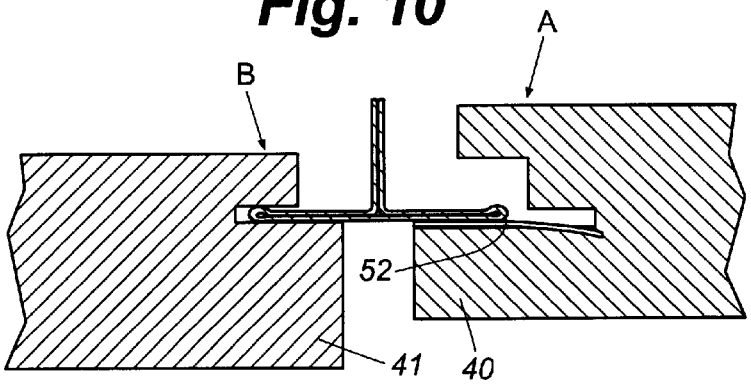

FIGS. 10 and 11 show an embodiment that use a security spring 52 to increase the upward pressure necessary to lift first edge A during the removal procedure. The convex compression spring 52 of inverted U shape extends lengthwise in the first edge A.

Unless increased upward pressure is exerted on first edge A, the spring interferes with the entry of the flange into access kerf 33 on first edge A, as shown in FIG. 7B of the removal process. FIG. 10 shows the spring 52 in relaxed form with the panel 20 installed in the ceiling 21. FIG. 11 shows the spring 52 in compressed form in the position shown corresponding to FIG. 7A of the removal procedure.

The invention can be used on panels with shapes other than rectangular. Such shapes must have opposed active first and second edges A and B with the profiles disclosed above. The remaining edges must all be passive, with no upper lips. Such shapes will have at least two opposed passive third and fourth edges C and D, each of which is positioned between the active first and second edges A and B.

What is claimed is:

1. A suspended ceiling panel system comprising a grid formed from an inverted T-section beam, said T-section beam having a flange, the system further comprising a ceiling panel capable of being installed and positioned into said grid from below said grid, said ceiling panel being configured such that when said ceiling panel is positioned within said grid, said ceiling panel is self-centering and locks in position, wherein said locking is both vertical and horizontal and further wherein said ceiling panel at least partially conceals said grid.

2. The suspended ceiling panel system of claim 1, said ceiling panel further comprising edges, said edges having at least a one-step positioning riser, wherein said self-centering occurs by said ceiling panel being sized such that said positioning riser is in proximal contact with said flange to accomplish said vertical and horizontal locking.

3. The suspended ceiling panel system of claim 1, said ceiling panel being capable of substantially concealing said grid.

4. The suspended ceiling panel system of claim 1 and wherein the configuration of said ceiling panel provides a positive indication of the direction said ceiling panel is to be moved to de-install said ceiling panel from said ceiling panel system and wherein said indication is not visibly detectable when said ceiling panel is installed.

5. The suspended ceiling panel system of claim 1 and wherein said flange has a width of about 15/16 inches.

6. A suspended ceiling panel system comprising:

a grid comprising an inverted T-section beam; and a ceiling panel comprising:

a) at least four edges, wherein at least one of said edges has a different cross-sectional profile than at least one other of said edges;

b) wherein said edges at least partially conceal said grid when viewed from below the suspended ceiling panel system;

c) wherein said ceiling panel is configured such that said panel is locked in place when installed, and wherein said panel is locked in place both vertically and horizontally; and d) further wherein said ceiling panel is self-centering, resulting in a ceiling panel system having a uniform appearance.

7. The suspended ceiling panel system of claim 6, said ceiling panel being capable of substantially concealing said grid.

8. The suspended ceiling panel system of claim 6 and wherein the configuration of said ceiling panel provides a positive indication of the direction said ceiling panel is to be moved to de-install said ceiling panel from said ceiling panel system and wherein said indication is not visibly detectable when said ceiling panel is installed.

9. The suspended ceiling panel system of claim 6 and wherein said T-section beam comprises a flange, said flange having a width of about 15/16 inches.

10. The suspended ceiling panel system of claim 4 and wherein said positive indication is revealed when an upward force is applied to said ceiling panel.

11. The suspended ceiling panel system of claim 10 and wherein said upward force is applied to a center portion of said ceiling panel.

12. The suspended ceiling panel system of claim 8 and wherein said positive indication is revealed when an upward force is applied to said ceiling panel.

13. The suspended ceiling panel system of claim 12 and wherein said upward force is applied to a center portion of said ceiling panel.

14. A suspended ceiling panel system comprising a grid formed from an inverted T-section beam, said T-section beam having a flange, the system further comprising a ceiling panel capable of being installed and positioned into said grid from below said grid, wherein said ceiling panel at least partially conceals said grid, said ceiling panel being configured such that when said ceiling panel is positioned within said grid, said ceiling panel is self-centering and locks in position, wherein said locking is both vertical and horizontal and further wherein a positive indication of the direction said ceiling panel is to be moved to de-install said ceiling panel is not visibly detectable when said ceiling panel is installed.

15. The suspended ceiling panel system of claim 14 and wherein said positive indication is revealed when an upward force is applied to said ceiling panel.

16. The suspended ceiling panel system of claim 15 and wherein said upward force is applied to a center portion of said ceiling panel.

17. The suspended ceiling panel system of claim 14, said ceiling panel further comprising edges, said edges having at least a one-step positioning riser, wherein said self-centering occurs by said ceiling panel being sized such that said positioning riser is in proximal contact with said flange to accomplish said vertical and horizontal locking.

18. The suspended ceiling panel system of claim 14, said ceiling panel being capable of substantially concealing said grid.

19. The suspended ceiling panel system of claim 14 and further comprising said grid formed from an ordinary inverted T-section beam, said T-section beam having an ordinary flange.

20. The suspended ceiling panel system of claim 14 and wherein said T-section beam comprises a flange, said flange having a width of about 15/16 inches.

21. A suspended ceiling system comprising a support grid framework formed from intersecting inverted T-shaped beams that define an array of grid openings each bordered by horizontal flanges of said T-shaped beams, and a plurality of ceiling panels for installation in receptive ones of said grid openings to define a ceiling, each of said ceiling panels having one edge formed with a registration kerf sized to receive a horizontal flange bordering one side of a grid opening and another edge opposite said one edge, said another edge being formed with a registration step and an access kerf, said access kerf being sized to receive a horizontal flange bordering the opposite side of the grid opening, each of said ceiling panels being installable in the respective grid opening from below by sliding said access kerf onto a first horizontal flange of said grid opening, pivoting said ceiling panel upwardly to align said registration kerf with the opposite horizontal flange of said grid opening, and moving said panel to slide said registration kerf onto said opposite horizontal flange until said first horizontal flange moves from said access kerf to said registration step to align said ceiling panel within said grid opening.

22. The suspended ceiling system of claim 21 and wherein said registration kerf and said access kerf are substantially horizontally extending kerfs when said ceiling panel is in a level horizontal orientation.

23. The suspended ceiling system of claim 21 and wherein each of said registration kerf and said access kerf further comprise at least a one-step positioning riser.

24. The suspended ceiling system of claim 21 and wherein said ceiling panel is self-centering and locks in position both vertically and horizontally within said grid opening.

25. The suspended ceiling system of claim 24 and wherein a depth of said registration step and said registration kerf is sized to accomplish said self-centering of said ceiling panel within said grid opening.

26. The suspended ceiling system of claim 23 and wherein said ceiling panel is self-centering and locks in position due to said positioning riser being in proximal contact with said T-shaped beams.

27. The suspended ceiling system of claim 21, said ceiling panel being formed with lower lips extending peripherally around said ceiling panel for at least partially concealing said support grid framework.

28. The suspended ceiling system of claim 21, said ceiling panel further comprising at least two additional edges adjacent to and connecting said one edge and said another edge, each of said additional edges having a wall positioned for proximal contact with an adjacent horizontal flange of said grid opening for centering said ceiling panel within said grid opening.

* * * * *